United States Patent [19]

Comtois

[11] Patent Number: 4,545,309

[45] Date of Patent: Oct. 8, 1985

[54] FURNACE FOR BURNING FLAMMABLE PARTICLES

[76] Inventor: Raoul Comtois, 19730 Côte Nord, Sainte-Thérèse, Canada, J7E 4H5

[21] Appl. No.: 595,654

[22] Filed: Apr. 2, 1984

[51] Int. Cl.[4] ..... F23H 3/00

[52] U.S. Cl. ..... 110/300; 110/102; 110/117; 110/244; 110/260; 110/286; 110/292; 110/293; 110/327; 414/327

[58] Field of Search ..... 110/102, 108, 112, 116, 110/117, 243, 244, 251, 252, 256, 260, 262, 267, 286, 300, 327, 292, 293; 414/304, 325, 327

[56] References Cited

U.S. PATENT DOCUMENTS

| | | | |
|---|---|---|---|
| 309,920 | 12/1884 | Bird | 414/327 |
| 591,752 | 10/1897 | Fisher | 110/116 |
| 667,061 | 1/1901 | Clarkson | 110/117 |
| 789,849 | 5/1905 | Gardner | 110/116 |
| 1,000,587 | 8/1911 | Crowe | 110/108 |
| 2,604,217 | 7/1952 | Shaw | 414/327 |
| 3,924,548 | 9/1975 | Du Chambon | 110/244 |
| 4,162,686 | 7/1979 | Infield et al. | 110/260 |
| 4,312,278 | 1/1982 | Smith et al. | 110/102 |
| 4,412,814 | 11/1983 | Dennis, Jr. et al. | 110/102 |
| 4,414,904 | 11/1983 | Foster | 110/300 |

FOREIGN PATENT DOCUMENTS

| | | | |
|---|---|---|---|
| 33824 | 2/1890 | Canada . | |
| 1004086 | 1/1977 | Canada . | |
| 1025284 | 1/1978 | Canada . | |
| 2502744 | 10/1982 | France | 110/251 |

*Primary Examiner*—Albert J. Makay
*Assistant Examiner*—Steven E. Warner

[57] ABSTRACT

There is disclosed a furnace for burning wooden wastes and, more specifically, sawdust and/or barks. The furnace is provided with an oil burner required for starting the fire. The draught from the oil burner fan is directed within a perforated box, located in the combustion chamber of the furnace, and the sawdust or the barks or other wooden particles fall, according to a measured flow, over the perforated box. The sawdust is first alighted by the oil burner flame, and combustion thereafter builds up thanks to the draught from the perforated box. This box draught comprises a vertically-upwardly-oriented vector, for alighting the wood particles before the latter reach the box, and a horizontal vector extending toward the interior of the furnace to force the burning particles away from the side wall of the furnace. The system includes measured flow feeding system for the sawdust and/or the bark, and having a pair of flap-doors to prevent the escape of smoke from the furnace.

9 Claims, 11 Drawing Figures

FURNACE FOR BURNING FLAMMABLE PARTICLES

FIELD OF THE INVENTION

The present invention relates to a furnace such that the burning material is made of solid particles, as for example sawdust, tree bark and others and, more specifically, to a furnace as above described adapted for domestic use.

BACKGROUND OF THE INVENTION

It is known in the art to provide furnaces for burning wood particles and other similar materials, but these furnaces are generally of the industrial type and require complicated means for starting the fire and for producing an upward draught within the furnace in order to maintain the particles in suspension during their combustion. Known systems also includes complicated means for feeding the furnace with particles according to a measured flow.

OBJECTS OF THE INVENTION

The general object of the invention is to provide a furnace which can burn flammable particles and which is of simple and economical construction, in order to be fit for use as a domestic furnace.

A more specific object of the invention is to provide a furnace of the described characteristics, wherein an oil burner of known type is used for alighting and also for providing primary and secondary air for the combustion of the particles.

Another object of the present invention consists in providing the above-described furnace with means for the particles feeding according to a measured flow.

Another object of the invention consists in providing means for preventing smoke from escaping from the furnace through the feeding duct of the flammable material.

SUMMARY OF THE INVENTION

According to the invention, the furnace itself, which may be of the warm air type as well as of the warm water type, is provided within the burning chamber thereof with an L-shaped air box, of which upper and side walls are perforated. An oil burner, of conventional type, communicates with this box and the latter is provided with a passage in registry with the nozzle of the oil burner. The flammable particles feeding is done through an inclined chute, opening inside the interior of the burning chamber, immediately over the horizontal portion of the air box. The oil burner is controlled so that, at the start, a flame fed by the oil is set up. Thereafter, the particles, such as sawdust particles, are discharged in the flame over the box at a measured flow and, when the particles are alighted, the oil nozzle is shut off and the combustion proceeds only by further burning of the flammable particles.

The particles are preferably stored in a reservoir, provided with a vertical bucket conveyor; the upper conveyor buckets discharge a measured quantity of particles into the chute, which directs this quantity into the combustion chamber. Rotating arms push the particles toward the buckets. They work the top layer of the mass of particles and are gradually lowered together with the reduction of the mass height within the reservoir. The inclined chute is provided with a pair of flap-doors, to prevent the escape of smoke without hampering the furnace feeding through this chute.

The above will become clearer by referring to the annexed drawings which illustrate a preferred embodiment of the invention.

DETAILED DESCRIPTION OF THE INVENTION

Figure 1:
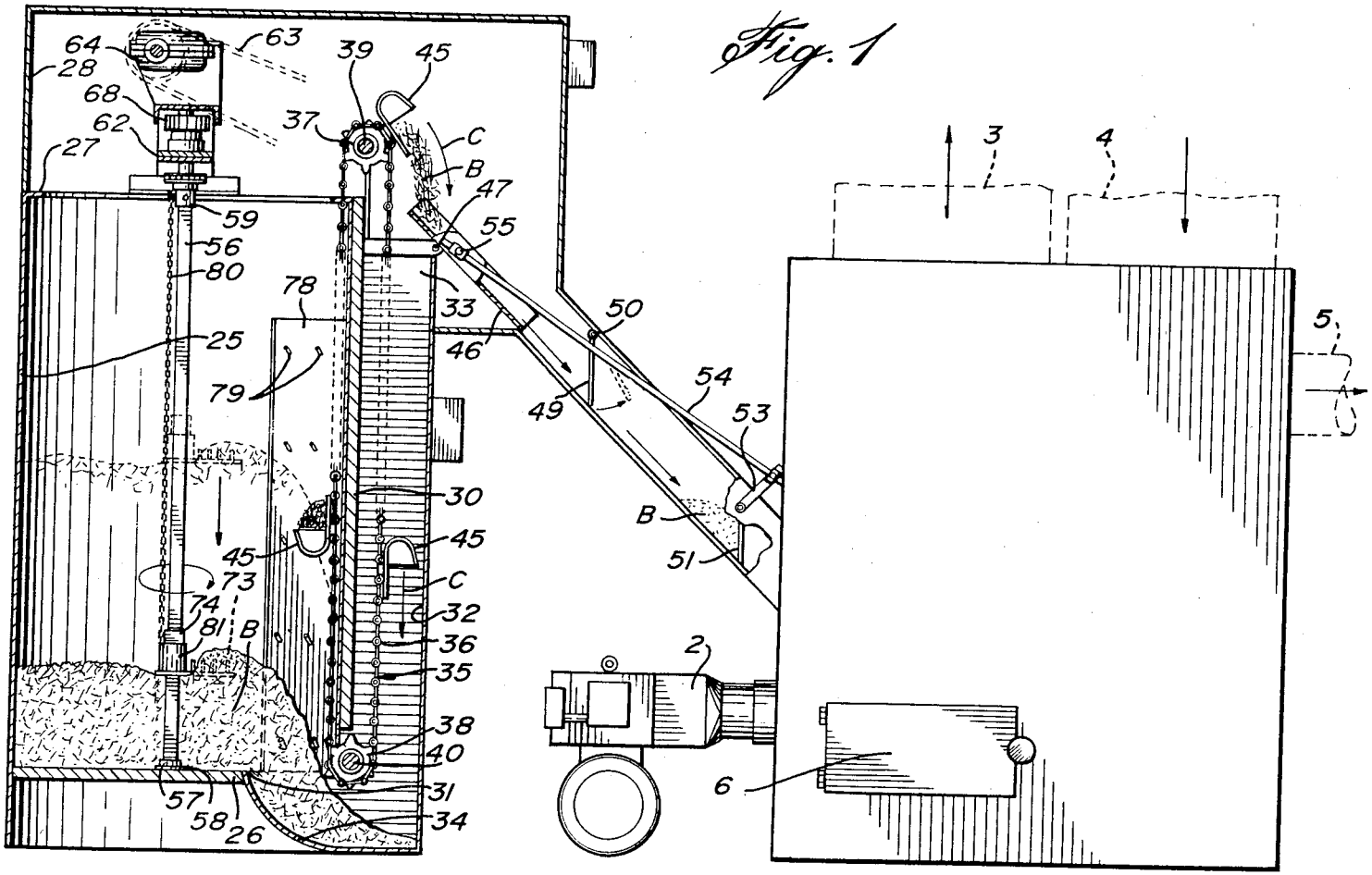
FIG. 1 is a view in elevation of the furnace according to the invention, provided with an oil burner and a feeding system for flammable particles shown in vertical section.

In the annexed drawings, same reference numerals indicate same elements.

Figure 2:
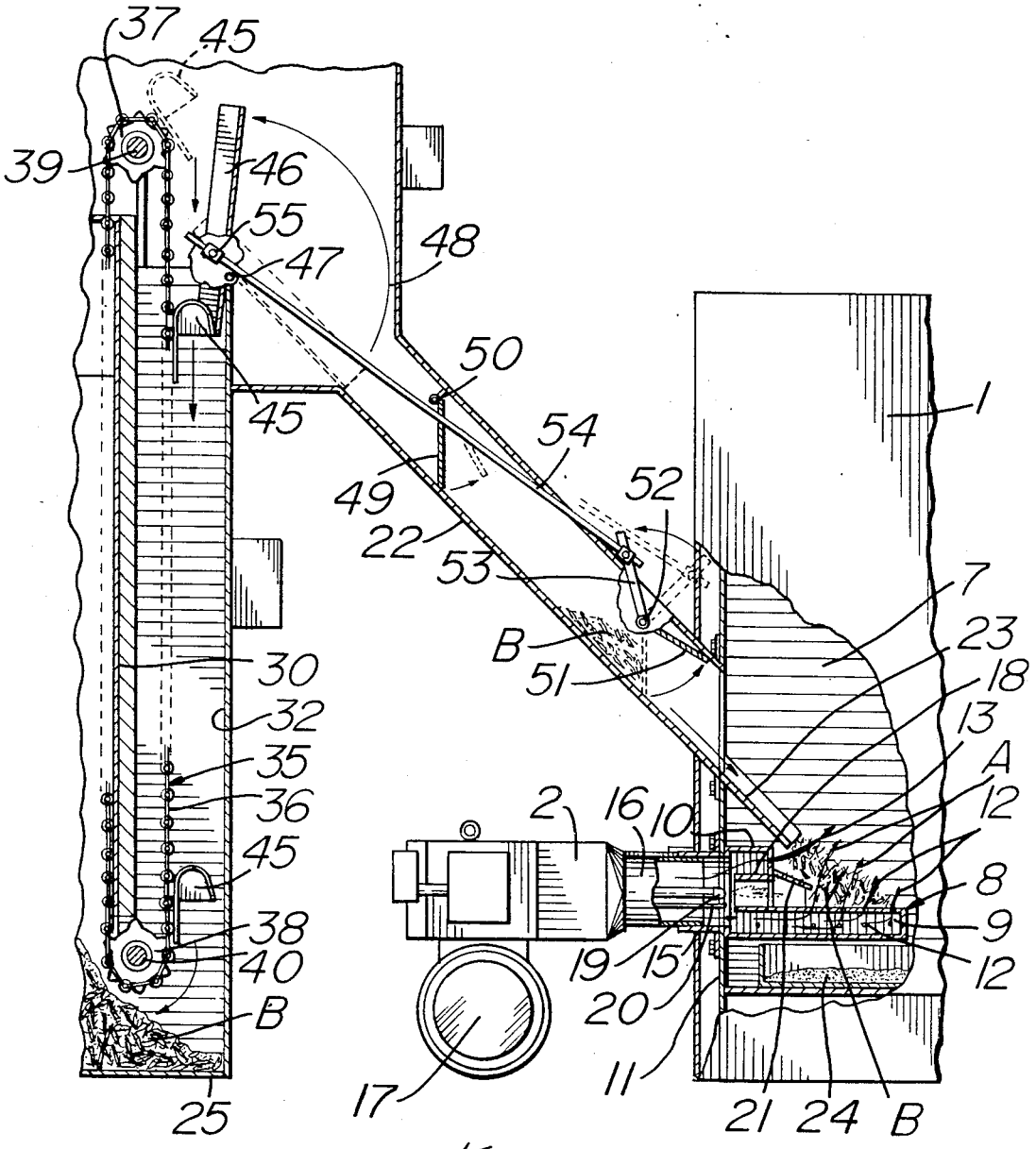
FIG. 2 is a view of a part of the elements shown in FIG. 1 in another position of the bucket conveyor system, this figure also showing in vertical section the air box within the furnace together with a partly longitudinal section of the oil burner.
Figure 11:
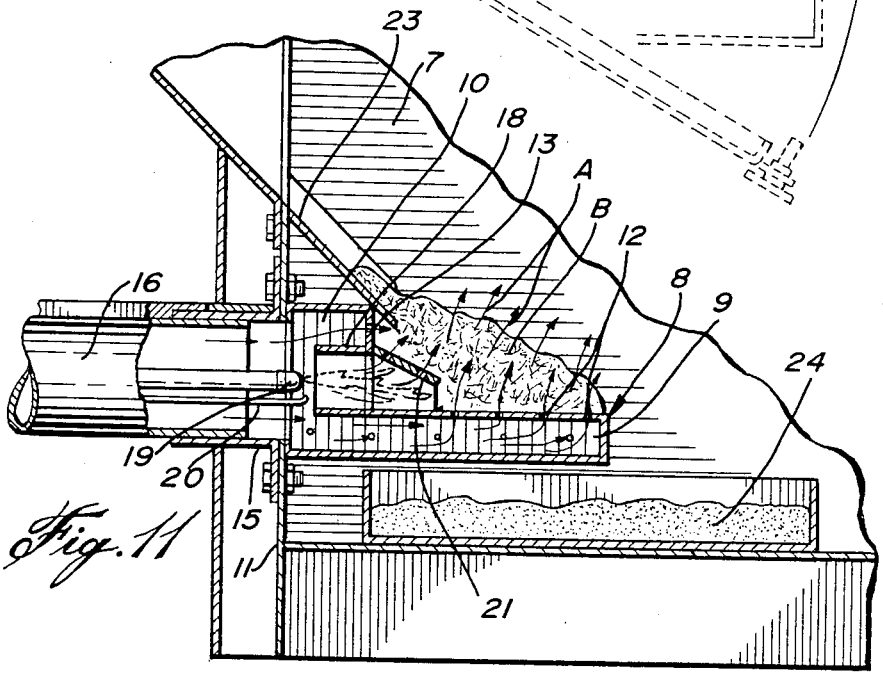

Referring to FIG. 1, the system according to the invention is intended to convert a furnace 1, of domestic type and provided with a conventional oil burner 2 into a furnace for burning sawdust, tree bark or other flammable particles. The furnace 1 may be of the warm air type, as illustrated, provided with a warm air duct 3, a fresh air intake 4, and a chimney pipe 5. However, the furnace could also be any warm water furnace. This furnace, of conventional type, is modified by addition of a door 6, which allows gaining access to ashes and the removal thereof. The burning chamber is shown in FIG. 2 and is indicated at 7. An air box 8 is located in the combustion chamber. This box 8 has an L-shape and comprises a horizontal leg 9 and a smaller vertical leg 10. The latter is fixed by bolts or other means to the internal vertical wall 11 of the furnace 1, whereas the horizontal leg 9 extends toward the interior of the combustion chamber 7. The two legs 9 and 10 are hollow and are in communication one with the other. The upper wall and the longitudinal side walls of the horizontal leg 9 are provided with a plurality of holes 12, equally distributed over the surface thereof. In the same manner, the vertical anterior wall of the vertical leg 10 is also provided with holes 13, equally distributed over the surface thereof. The rear of the vertical leg 10 is provided with a circular opening in full communication with a cylindrical sleeve 15 fixed to the outside of vertical wall 11 of the furnace, this wall being itself provided with an opening in registry with the sleeve 15. The sleeve 15 outwardly projects from the furnace 1 and fixedly connects with the cylindrical body 16 of the oil burner 2. Thus, the oil burner fan, powered by an electric motor 17, feeds pressurized air within the box 8, wherein the air exits through holes 12 and 13 to form a draught within the combustion chamber, which draught is upwardly and inwardly oriented within the furnace, as indicated by arrows A in FIGS. 2 and 11. The anterior wall of vertical leg 10 is perforated centrally thereof and therethrough, creating a passage defined by a sleeve 18 in registry with the nozzle 19 and the alighting electrode 20 of the burner 2. Thus, the flame fed by the oil burner from nozzle 19 goes through the sleeve 18 together with part of the pressurized air produced by the burner fan. This flame is directed against the upper wall of the horizontal leg 9 through the use of deflector 21 fixed to the front part of the vertical leg 10 relative to the sleeve 18.

The wood particles, indicated at B, are brought into the combustion chamber 7 by a downwardly-inclined chute 22 having a lower end 23 located immediately over the air box 8. The ashes produced by the combustion of wood particles B are gathered within a container 24, located under the airbox and accessible by the opening of the door 6 for the removal of the ashes.

Figure 3:
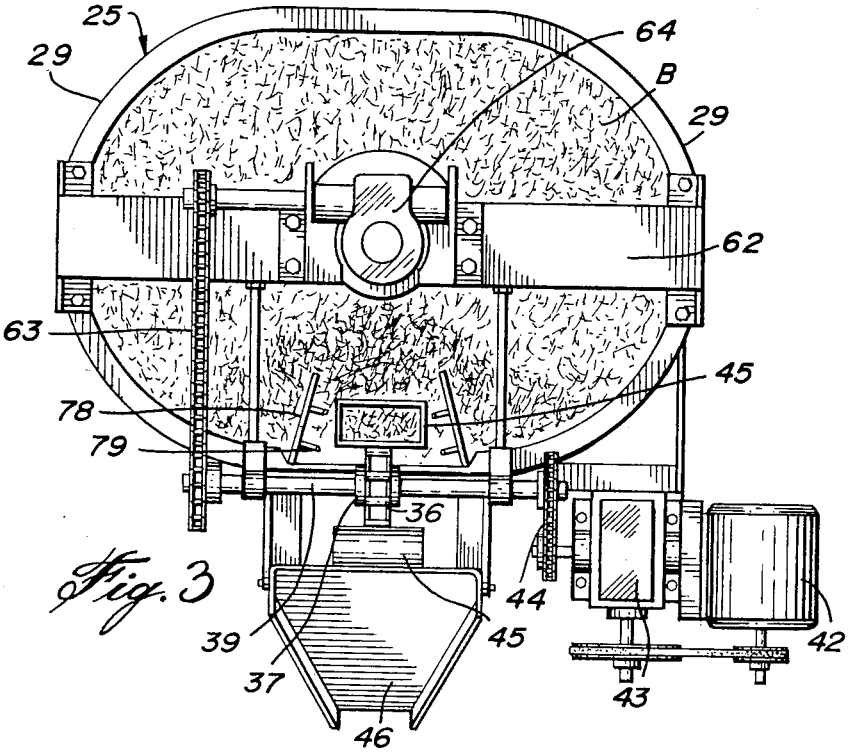
FIG. 3 is a top plan view of the particles reservoir of the feeding system.

Means are provided for feeding the furnace with flammable particles, such as sawdust or comminuted bark. A reservoir 25 contains a stock of flammable particles B. This reservoir includes a bottom floor 26 maintained spaced from the ground, and is opened by its upper end at 27 to allow the filling-up thereof after the cover 28 has been removed. As shown in FIG. 3, the reservoir 25 preferably has a generally ellipsoidal cross-section, being provided with two half-rounded sides 29. The lower end of the front wall 30 of the reservoir 25 is open (FIG. 1), together with the front portion of the bottom floor 26, to form an aperture 31 which permits communication between the inside of reservoir 25 and the lower end of a vertical compartment 32 located forwardly of the front wall 30. This compartment 32 is opened at its upper end, as indicated by 33. The bottom of compartment 32 is defined by a curved wall 34 which joins the front edge of floor 26.

Figure 4:
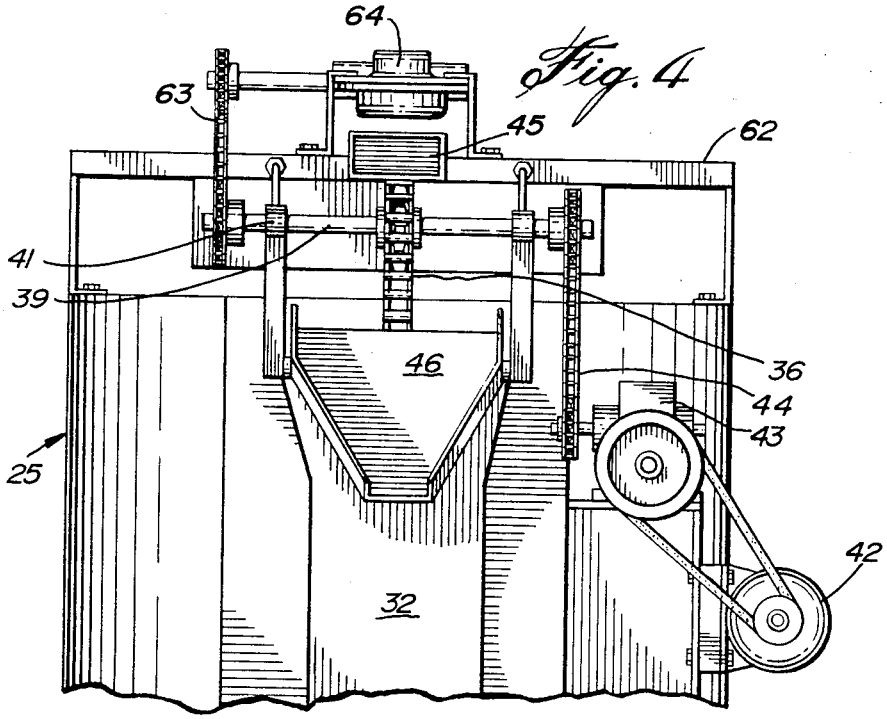
FIG. 4 is a partial front elevation of the elements of FIG. 3.

A bucket conveyor 35 is vertically mounted within the compartment 32 and within the inside of reservoir 25. This conveyor includes an endless chain 36 trained on sprocket wheels 37 and 38, eachj of the latter being mounted on a horizontal axle 39 and 40, respectively, and located in registry with the upper end and the lower end, respectively, of the front wall 30. The upper axle 39 is supported by pillow blocks 41 and is driven by an electric motor 42 (see FIGS. 3 and 4), through a speed reducer 43 (for example, with a 50 to 1 ratio), and by a system of chains and gear wheels 44. The endless chain 36 of the conveyor 35 supports a plurality of buckets 45, equally spaced apart along the chain. The conveyor is drawn toward the direction indicated by arrows C in FIG. 1, wherein the buckets 45 move down through the compartment 32; move thereafter through the opening 31, sweeping the curved wall 34; and after move up within the reservoir 25 in straight position for the gathering of a predetermined quantity of flammable particles. When they reach the upper end of the conveyor, the buckets, when they rotate around the upper axle 39, turn over and discharge a predetermined quantity of particles B over a rocking discharge plate 46, which in turn guides the particles B in the duct 22. Plate 46 is pivoted about a transverse axle 47 supported by the top of compartment 32, in the path of buckets 45, which, during the downward travel and after having discharged the content thereof, strikes plate 46 and makes it pivot upwardly following arrow 48, indicated in FIG. 2, in order to leave way for the buckets.

Means are provided for preventing smoke, which comes from the combustion of particles B in the combustion chamber of the furnace, to escape by the aperture created in the lateral wall of the furnace for the passage of chute 22. This chute has the general rectangular cross-sectional shape of a duct and is provided with a first flap-door 49, freely pivoted at 50 and located within the chute. This flap-door is normally closed by gravity, but will open under the action of the flammable particles. A second flap-door 51 is located in the duct 22, downwardly from the first flap-door 49. Flap-door 51 is pivoted at 52 and the axle thereof is provided with a lever arm 53 pivotally connected to a stem 54, which is itself pivoted at the other end thereof at a point 55 of plate 46 radially spaced from the pivotal axle 47 thereof. Referring to FIG. 1, when the plate 46 is in its lowered position, the bucket discharges the particles B, the latter opening the first flap-door 49, but being stopped by the second flap-door 51, which is then in a closed position.

When the overflow 46 is pivoted upwardly, as shown in FIG. 2, stem 54 opens the second flap-door 51 for clearing the particles B trapped behind the same. These particles will fall within the combustion chamber. Thus, there is always at least one closed flap-door to prevent the escape of smoke therefrom.

Means are provided for uniform feeding of the buckets 45 from the mass of particles B contained in the reservoir 25. These means also have the aim of preventing the localized compaction of the sawdust or other wood particles and to lower to a minimum the resistance exerted on the buckets during their upward travel within the reservoir.

Figure 5:
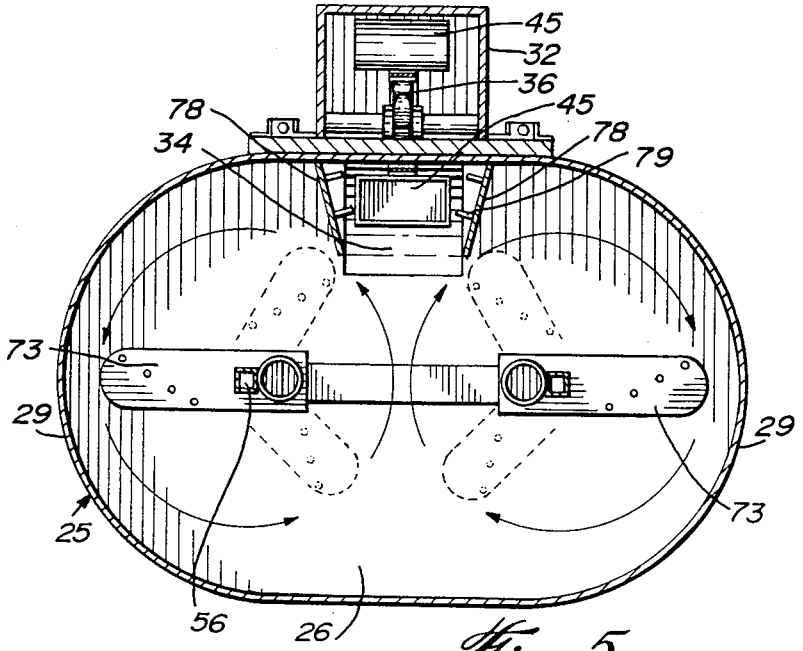
FIG. 5 is a horizontal sectional view of the reservoir.
Figure 6:
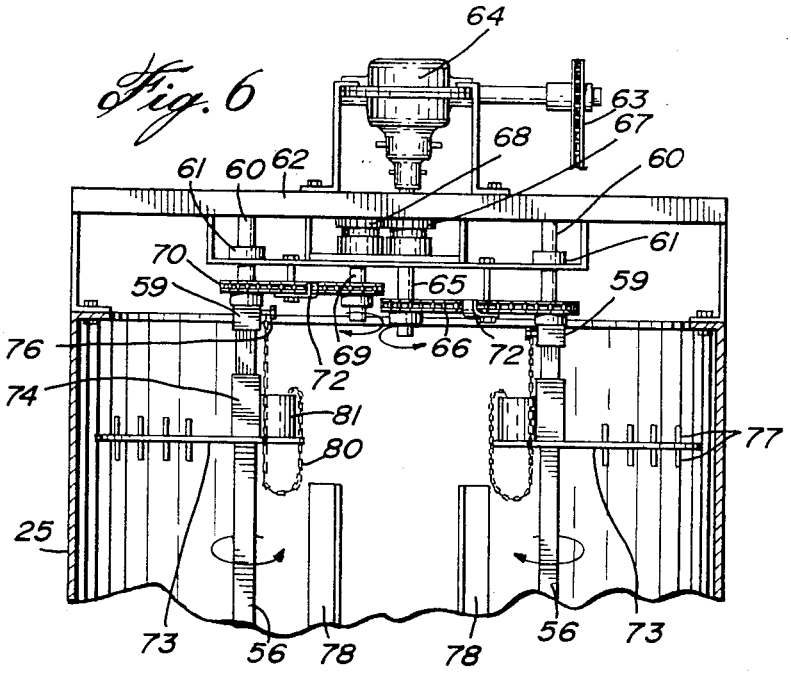
FIG. 6 is a partial vertical section of the reservoir.

Two stems 56, of square shape, are vertically mounted in the reservoir 25 according to the centers of curvature of the two terminal, half-rounded walls 29 of the reservoir 25, as shown in FIGS. 5 and 6. The lower end of each stem has a cylindrical shape and is rotatively mounted in a pillow-block 57, fixed to a support bar 58 fixed to the floor 26 of the reservoir 25, see FIGS. 1 and 5. The upper end of each stem 56 is inserted within a square bore sleeve 59 fixed to an axle 60, itself rotatively mounted in a pillow-block 61, and fixed to a structure frame 62 which is itself fixed on the top surface of reservoir 25, as shown in FIG. 6. Both stems 56 are brought into rotation in opposite direction by the electric engine 42, the speed reducer 43, the upper axle 39 of the conveyor 35, the chain and sprocket assembly 63, the speed reducer 64 (for example, with a 20 to 1 ratio) and a vertical axle 65 which drives one of the stems 56 through the chain and sprocket assembly 66. The axle 65 is provided with a gear wheel 67 which rotates in the opposite direction a gear wheel 68, to which is fixed an auxiliary vertical axle 69, which in turn drives the other stem 56 by a chain and sprocket assembly 70. The chains of assemblies 66 and 70 are each provided with a chain tightener 72. The stems 56 are of square shape and each carries a radial arm 73. Each radial arm is provided with a square bore sleeve 74 which may freely slide along the stem by gravity. The radial arms 73 float over the top of the mass particles B in the reservoir 25 and by inversely rotating, as shown in FIG. 5, the arms 73 will push the wood particles toward the center and front of the reservoir in the path of the buckets 45 during their upward movement. The relative angular position of the two arms 73 may be adjusted by modifying the angular position of one sleeve 74 or 59 on its stem 56. The angular position can be varied at 90-degree intervals. A projecting stud 76, which engages aligned bores of the stem 56 and of the sleeve 59, secures the two together.

When the particles B are sawdust the two arms 73 may be at a 90-degree angle one relative to the other; but when the particles B are tree bark or plywood waste strips or others, it has been found that it is much more preferable to maintain the radial arms 73 180° one relative to the other, as shown in FIG. 5. Accordingly, the rotational resistance exerted on the arms 73 is much reduced when these arms reach the floor of the reservoir 25. In the case of bark or wood strips, it has also been found that it is preferable to provide each of the radial arms 73 with a plurality of small pins 77 projecting upwardly and downwardly of each arm. These small pins are not required when the particles B are sawdust particles. For bark and wood strips, it is preferable to install on both sides of the upwardly-travelling buckets baffles 78 which converge toward the rear of the reservoir and which are provided with small pins 79 at their internal face. These baffles and these small pins retain the surplus of wood strips or bark that may protrude from the buckets 45 during their upward travel. Thus, the buckets are filled up in a uniform manner in order to feed the furnace with a substantially uniform flow.

With the described system, the radial arms 73 keep feeding the buckets while the level of wood particles in the reservoir 25 progressively falls. The reservoir may be fully emptied by the buckets, since the latter sweep the curved wall 34 in the bottom of the reservoir. When the reserve is fully emptied, it is easy to move upwardly each arm 73 with a chain 80, which top end is connected to the projecting stud 76 and which other end is fixed to the top of a cup 81, itself fixed to each radial arm 73. When the arms 73 are in their uppermost position, the chain 80 is put in the cup; the arms are maintained in uppermost position with a latch, not shown, and after having filled the reservoir with sawdust or other flammable particles, the latch is released.

Thus, the feeding system according to the invention permits to provide the furnace with a predetermined amount of particles B at regular intervals, which depend on the speed of the conveyor 35 and on the number of buckets which are herein connected.

The oil burner is provided with a conventional electric control circuit, but slightly modified by the addition of a delaying relay which cuts out the circuit of thre electromagnetic oil valve and opens the ignition transformer switch at the end of a predetermined time, for example between 30 to 180 seconds. Thus, practically speaking, the system can be completely automatic. When warming needs are felt in the house after the closing of the thermostat which measures the internal temperature of the house, the oil burner starts in the normal operation together with the electric motor 42 which is used for the feeding of wood particles. The flame fed by the oil burner appears immediately and is maintained in the combustion chamber, and a few seconds later, the wood particles are discharged in this flame; these particles are almost immediately alighted, and after approximately 30 to 180 seconds, the fire thus obtained by the combustion of the wood particles is sufficient to stop the oil feeding of the burner, and the fire is maintained only through the burning of particles.

The combustion of particles is practically thorough, since the ignited particles in fact float in an upward draught from the holes 12 of the air box 8. At the same time, the particles are prevented from burning too close to the lateral wall of the furnace, because of the holes 13 in the vertical wall of the air box. It is to be noted that the fan of the oil burner rotates non-stop, since the same is responsible for providing combustion air for the particles B. Preferably, the furnace is provided with a detector, such as a photoelectric cell, which, when it detects the absence of flame in the furnace, triggers the stopping of the motor 17 of the burner and of the motor 42. Then, a signal may be given warning the operator that the reserve of flammable particles is empty or that there is a problem in the particles feeding system.

Figure 8:
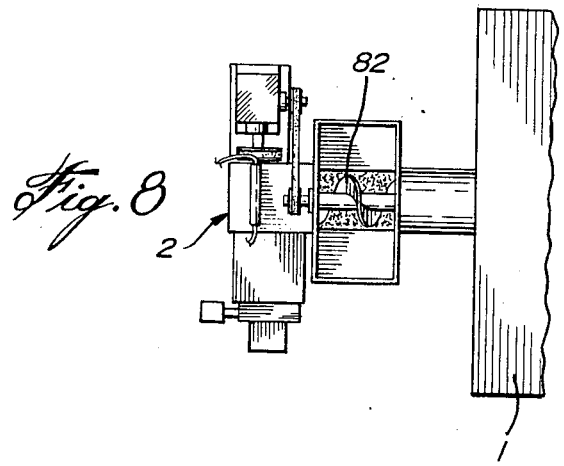
FIG. 8 is a top plan view of the elements of FIG. 7.
Figure 7:
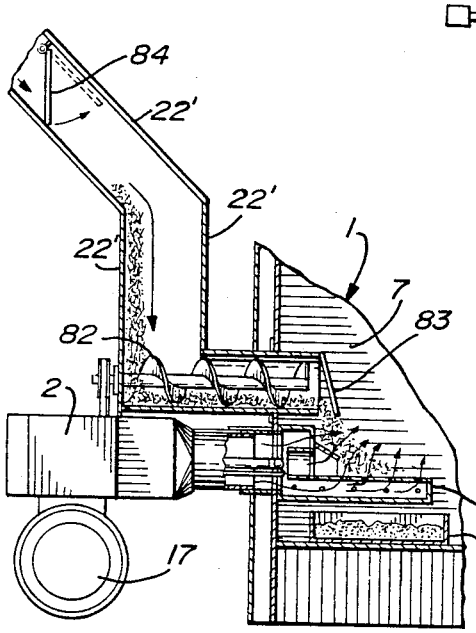
FIG. 7 is a partial vertical section of the burning chamber and of the modified chute for sawdust feeding.
Figure 9:
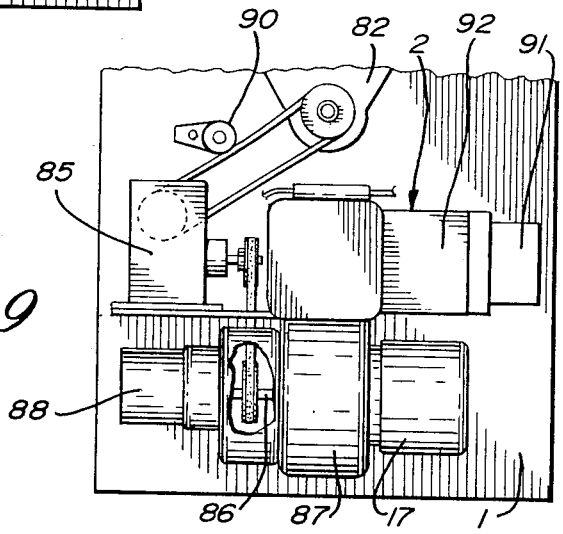
FIG. 9 is a rear view, in elevation, of the elements of FIG. 7.
Figure 10:
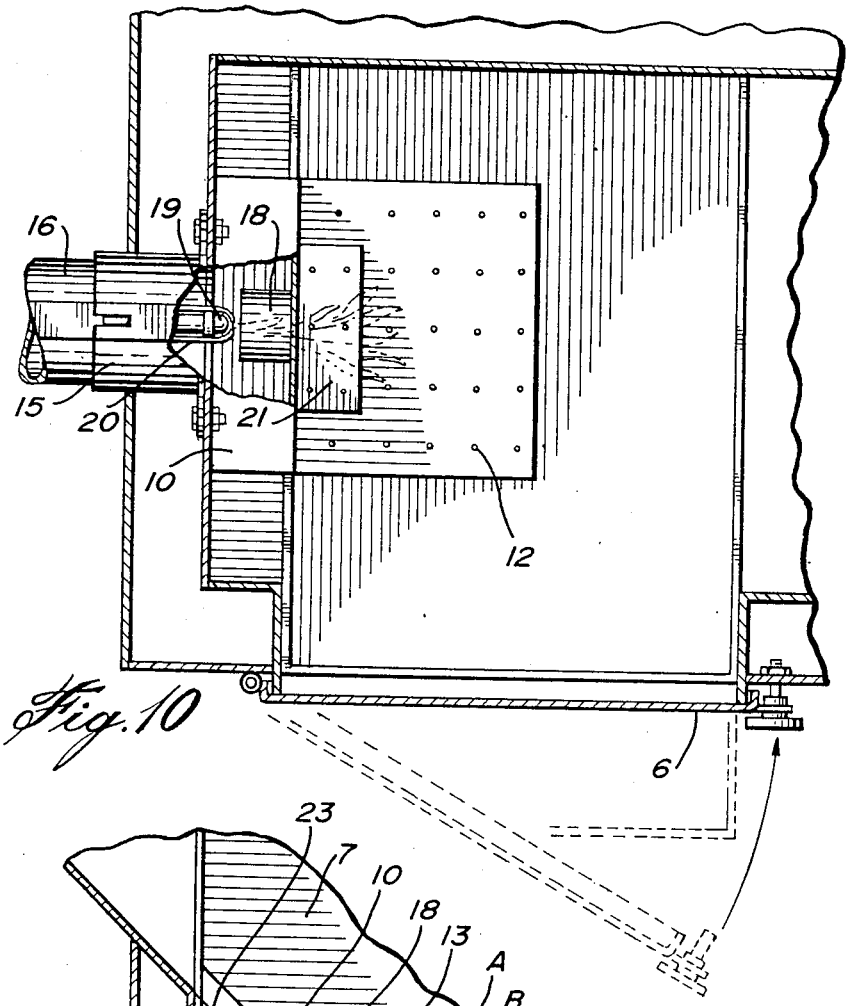
FIGS. 10 and 11 are a top plan section and a vertical section, respectively, of the furnace showing the burner and the air box.

Referring to FIGS. 7, 8, and 9, the feeding system is somewhat modified for burning more specifically sawdust as a flammable material. The system of air box and oil burner remains as in the first embodiment, but the chute 22 is modified in order to define a vertical end 22' for bringing the sawdust particles to fall directly in a wormscrew conveyor 82 horizontally located over the burner, and which discharges the sawdust particles over the air box 8. This allows the sawdust to flow in an absolutely uniform fashion and not in jerks, which would be the case should a whole bucket discharge directly into the furnace. The sawdust, should it not be uniformly discharged in the fire, would have a tendency to choke the fire. The discharging end of the conveyor 82 is provided with a flap-door 83 which, together with a second upper flap-door 84, prevents the smoke from escaping through the chute. The two flap-doors are freely pivotable and replaces the system of flap-doors 49 and 51, shown in the first embodiment.

The wormscrew of conveyor 82 is rotated at a reduced speed by a speed reducer 85 with a 40 to 1 ratio, for example, by the axle 86 of the electric motor 17 of the oil burner, this electric motor also driving the fan of the burner which is mounted internally of the casing 87 (see FIG. 9) and drives the oil pump 88 of the oil burner. The belt connecting the wormscrew conveyor axle to the output of the speed reducer 85 is preferably provided with a belt tensioner, indicated at 90. FIGS. 8 and 9 also show the control box 91 and the transformer 92 of the burner 2.

Obviously, flammable particle-igniting means other than a fuel oil burner can be used; for instance, a gas burner or an electric heating element provided with an air-feeding fan.

I claim:

1. In a furnace for burning flammable solid particles and including a combustion chamber having a vertical chamber wall and a bottom chamber wall delimiting part of said chamber, an air box, of L-shape, fixed to said chamber wall, having a hollow vertical leg with a lower end and contiguous to said chamber wall and a hollow horizontal leg communicating with the lower end of said vertical leg, longer than the latter and extending inwardly within said combustion chamber, spaced above and covering only a portion of said bottom chamber wall, said vertical and horizontal legs having an inner vertical and an upper horizontal main wall, respectively, each exposed within said chamber and each having a plurality of holes distributed thereover, said box having an inlet, means for feeding said box through said inlet with pressurized air to create air flow through said holes upwardly and also towards the interior of said combustion chamber, and means for discharging flammable solid particles into said combustion chamber over said horizontal leg and inwardly of said inner vertical wall of said vertical leg.

2. In a furnace as claimed in claim 1, further including an oil burner including a cylindrical body opened at the forward end thereof, an oil nozzle and an ignition electrode located within said cylindrical body for producing a pulverized oil jet and alighting the same respectively, the burner further comprising an air fan and an oil pump to provide pressurized air to said cylindrical body around said nozzle and to provide pressurized oil to the nozzle, said cylindrical body having the forward end thereof in communication with the interior of the vertical leg of said air box, so that the oil burner air fan constitutes the means for feeding said box with pressurized air, said vertical leg being further provided with a passage in register with said nozzle and of a diameter smaller than that of the cylindrical body of said oil burner, for the oil jet to move directly through said vertical leg into the combustion chamber with a part of the pressurized air, for producing in said combustion chamber a flame fed by said oil and by part of the pressurized air, said flame extending immediately over the horizontal leg of said air box, said flame being used for the ignition of said flammable solid particles.

3. In the furnace as claimed in claim 2, further including flammable solid particles feeding means, said feeding means including a reservoir for containing a mass of said particles, a vertical conveyor located in said reservoir to lift the particles outwardly from the reservoir, and receiving the particles provided by the conveyor and having a lower end located inwardly in said combustion chamber and over said air box, said duct lower end constituting said discharging means, said vertical conveyor including an endless chain and a plurality of buckets fixed to the chain and spaced apart one from the others, said buckets in their upward travel going through the mass of particles in the reservoir and rocking through 180 degrees at their uppermost point of travel, a discharge plate pivoted at the top of the duct and of the reservoir and taking under gravity a downwardly-inclined position in communication with said duct and in the path of the bucket initial downward travel, wherein the buckets, after having discharged said particles, and during their downward travel, strike and upwardly pivot said discharge plate which clears the buckets, said duct being provided therealong with two spaced-apart, pivotable flap-doors, to allow passage of the flammable solid material while preventing the escape of the smoke from said combustion chamber through said duct; the flap-doors comprising an upper flap-door and a lower flap-door, the upper flap-door being freely pivoted and the lower flap-door being mechanically connected to the discharge plate, wherein, when the latter is in said downwardly-inclined position, the lower flap-door is in closed position, and when the discharge plate is upwardly pivoted under the bucket action, the lower flap-door is in an open position.

4. In the furnace as claimed in claim 2, further including flammable solid particles feeding means, said feeding means including a reservoir for containing a mass of said particles, a vertical conveyor located in said reservoir and including a plurality of spaced buckets to lift the particles outwardly from the reservoir, and a downwardly-inclined duct from the top of the reservoir and receiving the particles provided by the conveyor and having a lower end located inwardly of said combustion chamber and over said air box, said duct lower end constituting said discharging means, said mass of particles comprising an upper part having a topmost layer, further comprising means in said reservoir for pushing the particles in the direction of the upwardly-moving buckets of said vertical conveyor, said means including two vertical stems rotatably mounted in said reservoir, means for rotating said stems in opposite directions, and a radial arm mounted on each stem for vertical sliding along the latter and rotation by the same, said radial arms being arranged for rotating in the upper part of the mass of particles contained in the reservoir and pushing said topmost layer of this mass in the direction of said buckets during the upward travel of the latter.

5. In the furnace as claimed in claim 4, wherein each radial arm carries spaced pins located transversely of the arm axis.

6. In the furnace as claimed in claim 4, wherein the relative angular position of the radial arms on the stems is adjustable.

7. In the furnace as claimed in claim 6, wherein each radial arm carries spaced pins located transversely of the arm axis.

8. In the furnace as claimed in claim 4, further comprising vertically-disposed baffles located in said reservoir on each side of the buckets in their upward travel, to limit the quantity of flammable particles to be pushed by said radial arms into the upwardly-moving buckets.

9. In the furnace as claimed in claim 8, wherein said baffles are provided with spaced pins directed towards the buckets to prevent the buckets from carrying a surplus of particles.

* * * * *